US007806065B1

(12) United States Patent
Bekker et al.

(10) Patent No.: US 7,806,065 B1
(45) Date of Patent: Oct. 5, 2010

(54) MODULAR SYSTEM FOR FAST AND EASY CONVERSION OF ANCHOR MOORED SEMI-SUBMERSIBLES TO DYNAMICALLY POSITIONED SEMIS WITHOUT THE NEED FOR DRY DOCKING, USING A DIESEL ELECTRIC THRUSTER SYSTEM

(75) Inventors: Joannes Raymond Mari Bekker, Houston, TX (US); Gene Milus Little, Cypress, TX (US)

(73) Assignee: Thrustmaster of Texas, Inc., Houston, TX (US)

( * ) Notice: Subject to any disclaimer, the term of this patent is extended or adjusted under 35 U.S.C. 154(b) by 177 days.

(21) Appl. No.: 12/243,797

(22) Filed: Oct. 1, 2008

(51) Int. Cl.
*B63H 25/02* (2006.01)
*G05D 1/02* (2006.01)
*B60L 11/00* (2006.01)
*B63H 21/17* (2006.01)

(52) U.S. Cl. ..... 114/144 B; 440/6

(58) Field of Classification Search ..... 114/144 R, 114/144 RE, 144 B, 144 E, 264–267; 440/6, 440/57

See application file for complete search history.

(56) References Cited

U.S. PATENT DOCUMENTS 4,436,050 A 3/1984 Liden
4,471,708 A * 9/1984 Wilson et al. ..... 114/265
4,878,864 A 11/1989 Van Bentem
5,036,782 A * 8/1991 Linde et al. ..... 114/65 R
5,403,216 A 4/1995 Salmi et al.
5,491,636 A 2/1996 Robertson et al.
6,247,421 B1 6/2001 Ludwigson
6,257,165 B1 7/2001 Danos, Jr. et al.
6,378,450 B1 4/2002 Begnaud et al.
6,439,963 B1 8/2002 Dreith et al.
6,453,838 B1 9/2002 Mowell et al.
6,668,746 B1 12/2003 Schia et al.
6,672,236 B1 1/2004 Pinsof
6,848,380 B1 2/2005 Sainz
6,848,382 B1 2/2005 Bekker
7,055,447 B1 6/2006 Bekker

* cited by examiner

*Primary Examiner*—Daniel V Venne
(74) *Attorney, Agent, or Firm*—Buskop Law Group, PC; Wendy Buskop

(57) ABSTRACT

A modular removable externally mountable diesel electric thruster system using azimuthing thrusters and a dynamic positioning system for positioning floating semi-submersible vessels with a ballasted waterline and at least one submerged pontoon.

13 Claims, 5 Drawing Sheets

MODULAR SYSTEM FOR FAST AND EASY CONVERSION OF ANCHOR MOORED SEMI-SUBMERSIBLES TO DYNAMICALLY POSITIONED SEMIS WITHOUT THE NEED FOR DRY DOCKING, USING A DIESEL ELECTRIC THRUSTER SYSTEM

FIELD

The embodiments relate to an integrated positioning and maneuvering system removably mountable on a water borne semi-submersible consisting of thrusters and self-contained power systems and controls.

BACKGROUND

Semi-submersible vessels are large cumbersome vessels that need to be kept steady over a well site. They also need to be repositionable relative to certain defined coordinates. Many of the semi-submersibles currently in use are not provided with any propulsion system machinery, but are moved by tugs and held in position by anchor moorings. A need has existed for a system for dynamic positioning of these semi-submersibles without a major vessel conversion in a dock.

As oil and gas exploration is extending farther offshore into deeper water there is a need to convert many of the existing semi-submersibles from anchor moored vessels to dynamically positioned vessels.

Even in some shallow water areas, the use of anchor mooring systems may be prohibited, for instance, due to the presence of coral reefs or in locations where there already are multiple pipe lines and cables on the ocean floor and the use of anchors could damage the coral reefs or break existing pipe lines and cables.

A dynamic positioning system with externally mounted thrusters, each thruster having a self-contained power unit and a dedicated control system, has long been needed. A modular positioning system has been needed where the thrusters, power units, and controls are not integral with any of the semi-submersible's systems, nor are they integral with the hull of the semi-submersible, such that they allow easy attachment to a pontoon at sea and easy removal at sea when the system is no longer required. A need has existed for a detachable system so that expensive thruster systems can be leased rather than being owned by an operator, thereby at least theoretically lowering the cost of exploring for oil and gas, and lowering the cost of fuel for a consumer at the pump.

Additionally, a need has existed for a modular system that can easily be increased or reduced in overall size and capacity to suit semi-submersible vessels of different sizes.

A need has also existed for a fully packaged, self-contained thruster system that is fully integrated, factory tested and class approved prior to installation on the semi-submersible, allowing vessel upgrades of dynamic positioning capability within just a short period of time, and at a minimal cost.

A need has existed for a system which is easy to service at sea, allowing minimal down time without the need for a semi-submersible to return to a yard or dry dock, and allowing the semi-submersible to continue operating at its work location without interruption, thereby increasing the profitability of the operation.

BRIEF DESCRIPTION OF THE DRAWINGS

The detailed description will be better understood in conjunction with the accompanying drawings as follows.

Figure 1A:
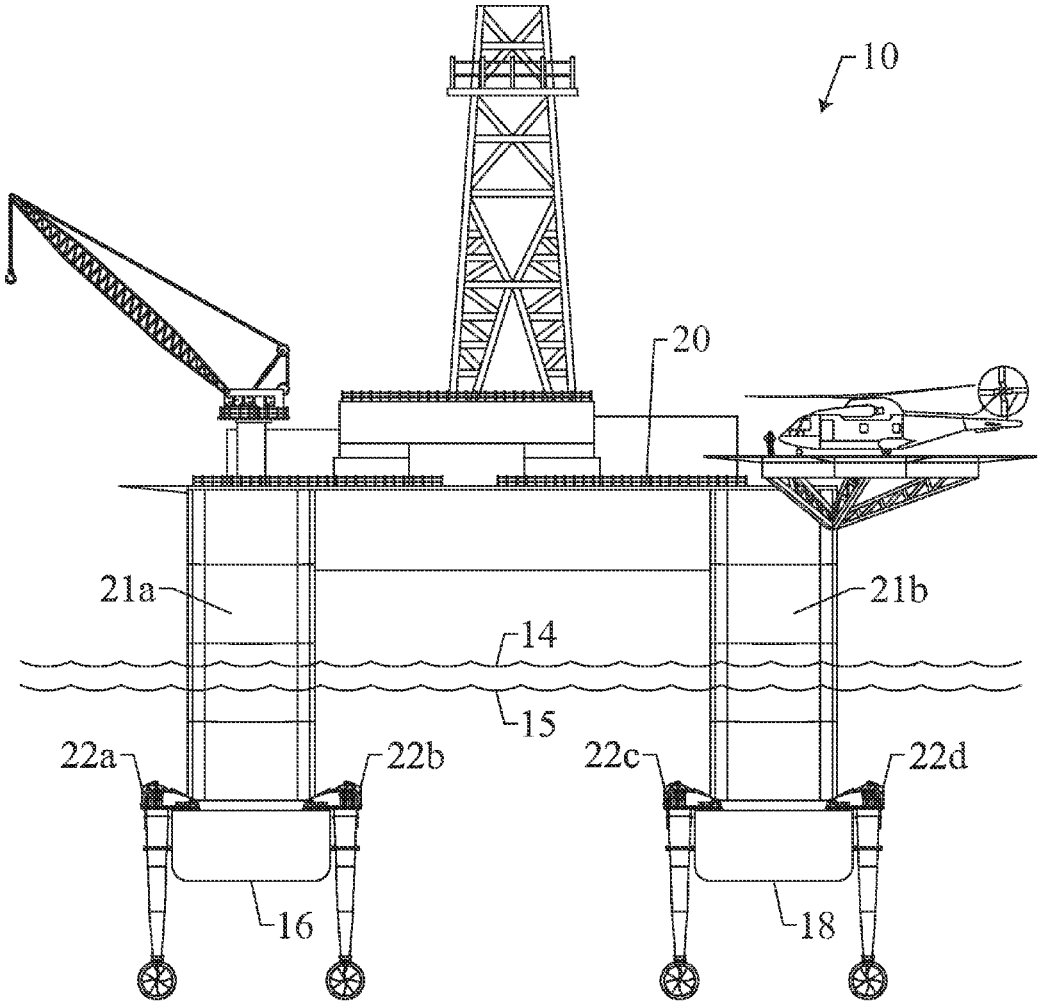
FIG. 1A depicts an aft view of a semi-submersible with multiple thrusters located thereon.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The embodiments relate to a modular, removable, externally mountable diesel electric thruster system for dynamic positioning of a floating semi-submersible vessel with a ballasted waterline. Embodiments work in vessels with at least one submerged pontoon, and as many as six pontoons. Each pontoon can have at least one vertical column integral with a top of the submerged pontoon. A deck structure can be attached to the vertical columns above the ballasted waterline.

In an embodiment, the system has at least one pair of azimuthing thrusters. Each azimuthing thruster provides 360 degrees of rotation of an associated propeller. Each azimuthing thruster can be removably mounted to at least one of the submerged pontoons or on the side of at least one of the submerged pontoons.

The azimuthing thrusters can be skid mounted to at least one pontoon. In an embodiment a pair of azimuthing thrusters can be removably mounted to opposite sides of each pontoon of the vessel. From one pair of azimuthing thrusters up to about 15 pairs of azimuthing thrusters can be used on a vessel for optimum dynamic positioning by an operator. The skid can be a flat plate, a U shaped plate, or H shaped plate, depending on the shape of the pontoon at the point of attachment. The skid is removably secured to a top portion or a side of the submerged pontoon below the ballasted waterline.

Each azimuthing thruster can generate a variable thrust for positioning the semisubmersible.

An upper thruster housing can removably connect to the skid. The upper thruster housing can have a slewing bearing and at least one electric motor driven slewing drive to steer the thruster. Additionally, the thruster has at least one electrical steering angle feedback sensor for indicating the steering angle of the azimuthing drive thruster and a multi-conductor slip ring assembly.

The electric pod can be made from steel to protect the contents of the electric pod from weather. The electric pod contains an electric motor. The electric motor inside the electric pod rotates a propeller drive shaft, which in turn drives a fixed pitch propeller. The propeller provides a variable thrust for the azimuthing thruster system and is removably mounted to the propeller drive shaft. The propeller can be a three, four or five blade propeller.

A nozzle surrounds the propeller. The nozzle can be a tapered disposed housing around the propeller and secured to the electric pod.

A thruster electric power cable can connect to the electric motor on one end and to the multiconductor slip ring assembly on the other end.

At least one pair of diesel electric power units are removably secured to the deck. Each diesel electric power unit engages one of the azimuthing thrusters. Each diesel electric power unit has a power unit housing, a diesel engine within the power unit housing, an electric generator driven by the diesel engine, a variable frequency drive connected to the electric generator, a fuel tank connected to the diesel engine, a cooling system for cooling within the power unit housing, a starter system for the diesel engine, an exhaust system connected to the diesel engine, and a control system for controlling the diesel engine, electric generator, starting system, cooling system, fuel tank, variable frequency drive and combinations thereof. The engine can be on an engine mount for stability.

The self contained diesel electric power units can have a power unit housing made of steel or a similar rigid metal. The power unit housing can be weather tight.

In another embodiment the generator can be a single bearing generator and can be coupled to the diesel engine. The generator can be in communication with a voltage regulator, a generator control system, and a main breaker.

A dynamic positioning system connects to the diesel electric power.

At least two position reference sensors can be used, and at least two environmental reference sensors can be in communication with the dynamic positioning system.

The position reference sensors can provide position reference data. The position reference sensor can be a hydroacoustic sensor, a micro-wave sensor, a GPS differential sensor, a taut wire sensor, a reference sensor, or a laser sensor. Other position sensors capable of detecting drift of the vessel from a defined position can be used.

The invention can further include at least one motion reference sensor. The motion reference sensor can be used for providing motion reference data. The motion reference sensor can be a motion reference unit that is used to compensate for movement of the vessel due to roll, pitch, or yaw.

At least one heading reference sensor can be used for providing vessel heading data. The heading reference sensor can be a gyro sensor or a magnetic sensor.

An embodiment of the thruster system can include a wind sensor as one of the environmental sensors. The wind sensor measures wind data. The wind data can include wind direction and wind speed.

The dynamic positioning system can receive the position reference data, the motion reference data, the vessel heading data, and wind sensor data, and can send commands to the azimuthing thruster control system to position the vessel relative to these data inputs.

The dynamic positioning system can also receive feedback data from each azimuthing thruster control system. The feedback data can relate to the variable thrust of the azimuthing thruster and the steering angle of the azimuthing thruster.

In an embodiment, the diesel electric power unit has gas turbine driven electric power units instead of the diesel units.

In another embodiment, a power plant on the vessel generates power for the azimuthing thrusters.

In recent years, drilling operations have been conducted at greater distances from the shoreline, such as in deep waters over 7,500 feet. It is believed that embodiments can be used in water depths of about 10,000 feet. It is advantageous to deploy these floating semi-submersible vessels which do not use anchors, as opposed to fixed bottom anchored structures.

Designs of semi-submersible vessels utilize one or more buoyant pontoons or lower hulls, which support at least two vertically extending columns. The upper portion of the columns supports the deck or working platform. Some of the semi-submersibles are a single caisson or column, usually denoted as a buoy, while others utilize three or more columns extending upwardly from buoyant pontoons. Two-pontoon, four-column structures have been taught in the art, but there has been no teaching on moving these vessels using removable thrusters. Further, a need exists for an accurate and easy way to move these vessels.

The thrusters have to take into account roll motion induced by waves, and the inherent stability of the vessel for hostile environments. The embodiments enable a semi-submersible to have improved safety, maneuverability, and versatility, while enabling the thrusters to be used on other vessels in case the semi-submersible is left in position for a long period of time.

Embodiments can include positioning the semi-submersible with dynamically positioned thruster assemblies mounted on the pontoons.

The thruster assemblies can be retractable and can run from a number of self contained power units.

The pontoons can be divided into a plurality of watertight compartments for accommodating ballast as well as allowing the thruster assemblies to be secured to the top of the pontoons.

Embodiments relate to installing the thrusters at the top of the pontoons, not at the bottom of the pontoons. Only by installing at the top of the pontoons can the thrusters be removable and installable at sea or dock side without the need for divers or a dry dock. This is a significant advantage from a maintenance point of view. If one thruster goes out, or if the propeller hits a log or other debris floating in the ocean, another can be easily replaced without significant down time of the vessel.

A feature of embodiments is that the thrusters can be added onto the semi-submersible after it has been towed to a position, and then used to keep the vessel in place using 360 degree fixed pitch variable speed azimuthing thruster assemblies.

The heavy weather draft of the semi-submersible (the ballasted draft) is greater than the deballasted level.

There can be four thrusters located in identical positions on the second pontoon, forming a thruster system of eight azimuthing thrusters. Each pair of azimuthing thrusters can be removably mounted to opposite sides of one of the pontoons.

Figure 1B:
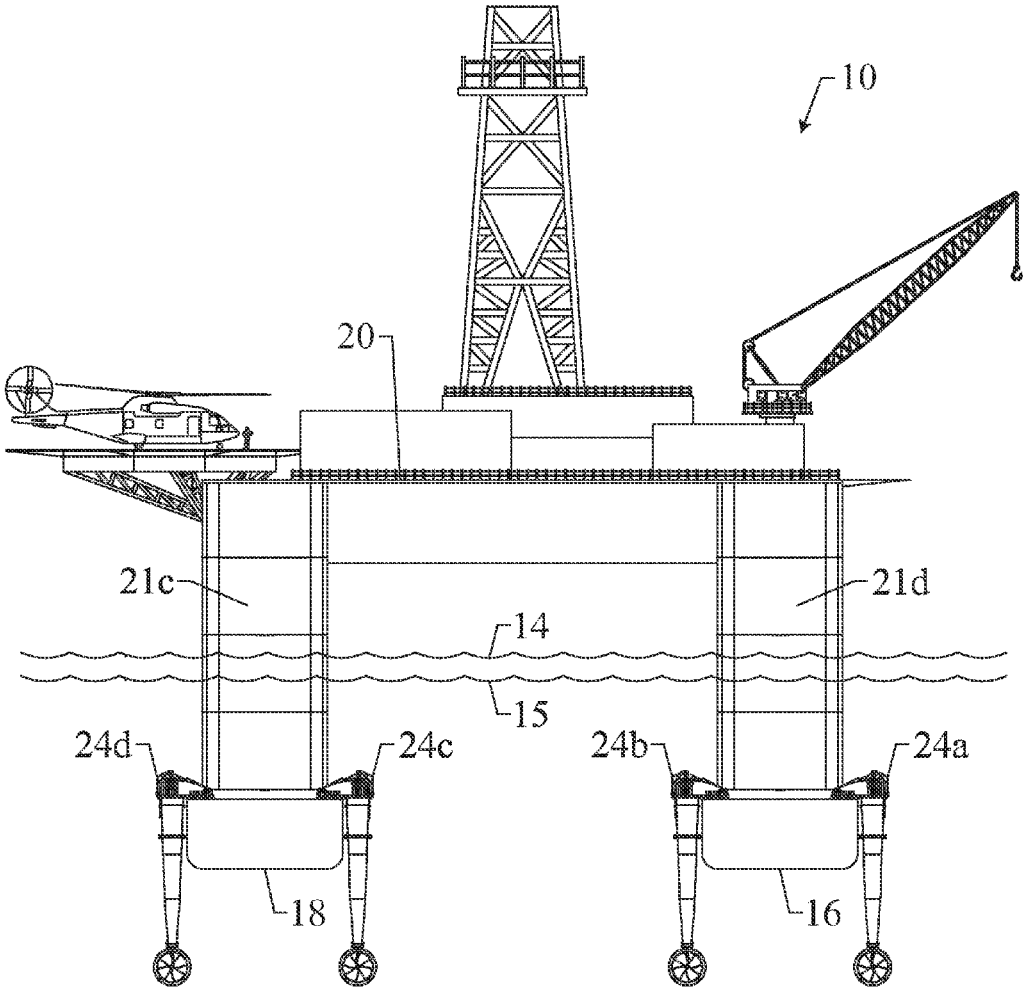
FIG. 1B depicts a front view of a semi-submersible with multiple thrusters located thereon.

The system, as shown in FIGS. 1A and 1B, depicts a floating semi-submersible vessel 10 with two pontoons (16, 18) having a ballasted waterline 14 differing from the floating semi-submersible vessel's 10 unballasted waterline 15. The first pontoon 16 parallels the second pontoon 18. Columns 21(*a, b, c, d*) engage the pontoons. A deck 20 is connected to the plurality of columns 21(*a, b, c, d*) which are secured to the top of the pontoons.

FIG. 1A illustrates, a pair of azimuthing thrusters 22(*a*, b) located at the bow of the first pontoon 16 on the top of the pontoon, and another pair 22(*c*, d) located at the bow and on the top of the second pontoon 18.

FIG. 1B illustrates another pair of azimuthing thrusters 24(*a*, b) on the stern of the first pontoon 16, on the top of the pontoon, and another pair of azimuthing thrusters 24(*c*, d) attached on the top of the second pontoon 18. While four columns are illustrated, the deck can be support by few columns or by more columns.

Figure 2:
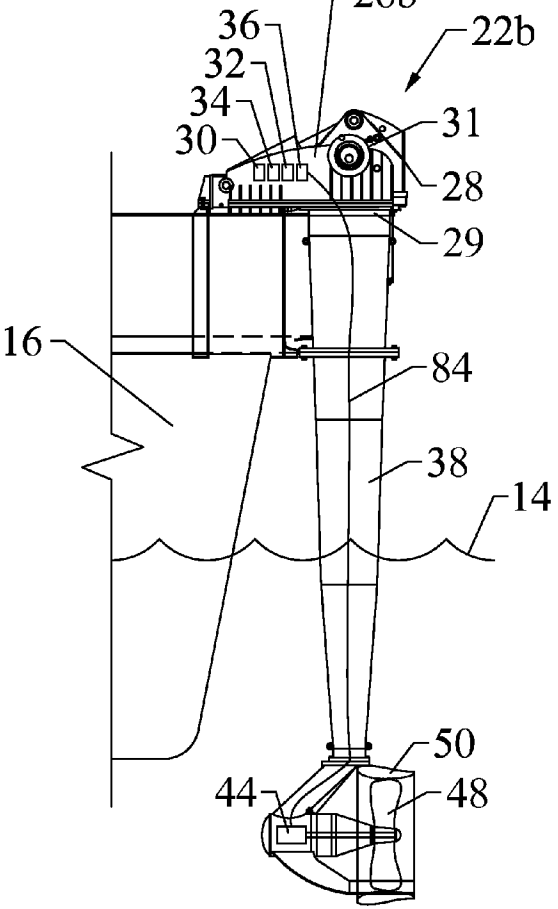
FIG. 2 depicts a side view of a thruster located on the top of a pontoon of a semi-submersible.

FIG. 2 shows a side view of a submerged pontoon 16 with the installed azimuthing thruster. The thruster 22*b* includes skid 26*b* removably secured to the pontoon 16 above the deballasted waterline 14. The thruster comprises an upper thruster housing 28 containing a steering motor 30, an electric motor driven slewing drive 32, at least one electrical steering angle feedback sensor 34, and a multiconductor slip ring assembly 36. The steering motor 30 can be an electric steering motor 30 which engages the electric motor driven slewing drive 32. The electric motor driven slewing drive 32 engages a slewing bearing within the upper housing 28 for rotating the azimuthing thruster 22*b*. A thruster electric power cable 84 connects the multiconductor slip ring assembly 36 to the electric motor 44. The multiconductor slip ring assembly 36 provides a means for providing power to the electric motor 44 which rotates as a part of the azimuthing thruster.

A connector 31 is used to removably hold the upper thruster housing 28 to the skid 26*b*. A tube 38 is depicted removably connected to the upper thruster housing 28. The tube can be movably mounted to the upper thruster housing 28 using a slewing bearing 29.

The tube 38 can be removably connected to the upper thruster housing 28 at one end and can be removable secured to the electric pod (not shown in this Figure) with a propeller 48 and a nozzle 50 at an opposite end. The tube can be hollow to allow for lower weight and ease of transport in addition to providing a conduit for the thruster electric power cable 84 which can connect the motor 44 to a power source.

The tube 38 can have a length that is long enough to extend the propeller 48 below the pontoon 16. The inner diameter of the tube 38 can range from about 12 inches to about 120 inches. In another embodiment, the tube 38 can be a tapered configuration.

Figure 3:
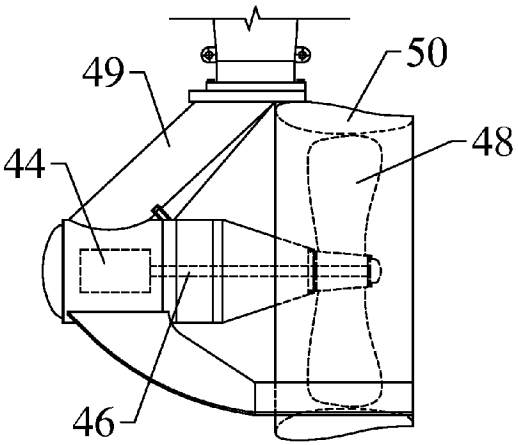
FIG. 3 depicts side view of an electric pod of an azimuthing thruster.

FIG. 3 shows a side view of the electric pod 49. The electric motor 44 is connected to the propeller drive shaft 46 which engages the propeller 48. The electric pod 49 contains the electric motor 44. The electric motor drives the propeller drive shaft 46, which is also contained within the electric pod 49. The propeller drive shaft 46 drives the propeller 48 at an RPM proportional to the RPM of the electric motor.

The propeller 48 is surrounded by a nozzle 50, which is secured to the electric pod 49. The nozzle 50 increases the thrust of the propeller 48. The nozzle 50 can be tapered to orient the wash of the thruster.

The electric motor 44 can be a variable speed AC electric motor. The variable frequency drive controls the RPM of the AC electric motor.

In an alternative embodiment of the invention the electric motor can be a variable speed DC electric motor. A silicon-controlled rectifier (SCR) controls the RPM of the DC electric motor. It is further contemplated that the electric motor is reversible.

Figure 4:
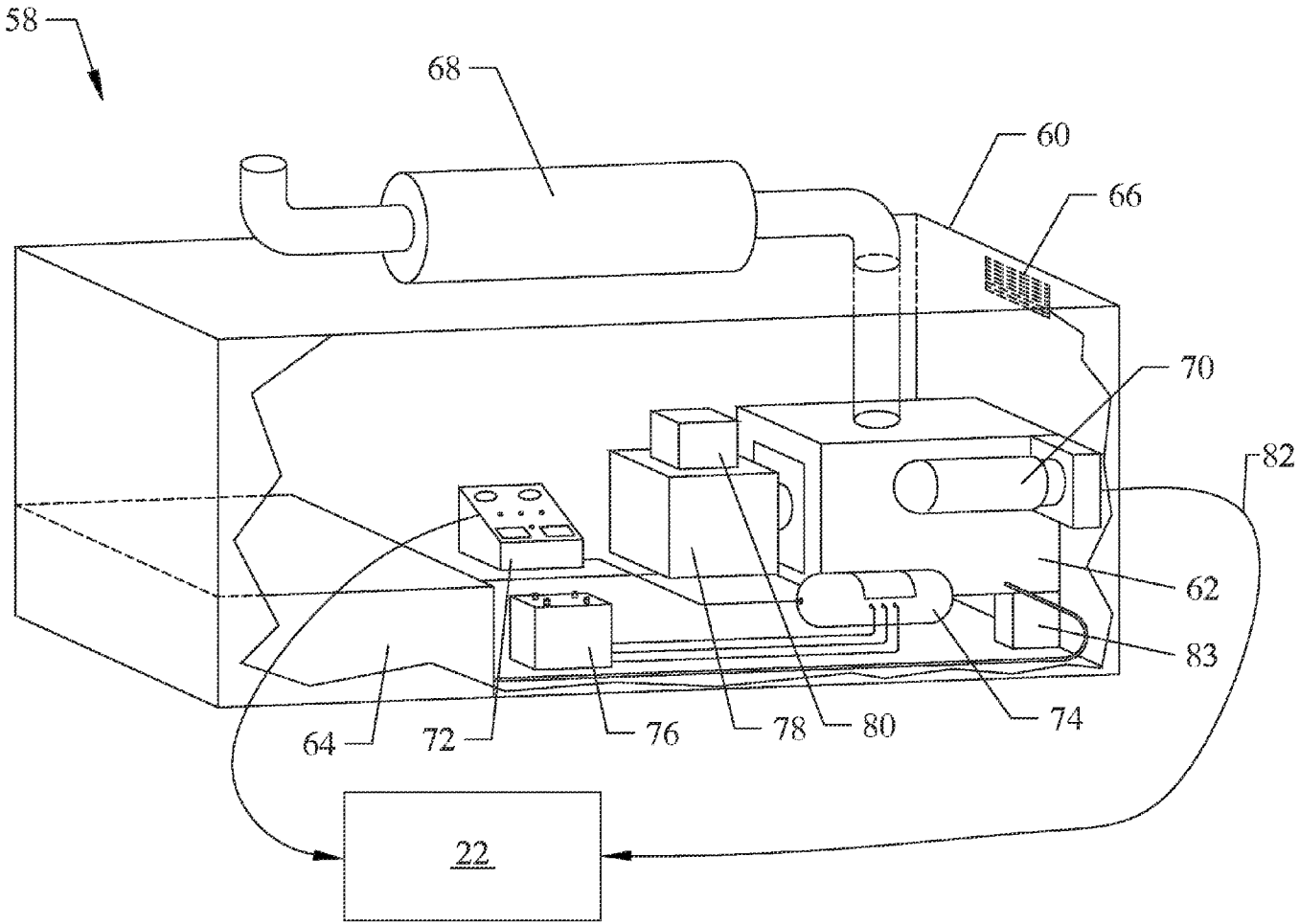
FIG. 4 depicts a perspective view of the interior of the self-contained power unit.

FIG. 4 shows the diesel electric self-contained power unit 58. The self-contained power unit 58 has a power unit housing 60 removably securable, such as with bolts or other fasteners, to the deck of the semi-submersible vessel. Self-contained power units can be secured to the vessel above a ballasted waterline. Each of the self-contained power units can engage at least one of the azimuthing thrusters 22. In an alternative embodiment the self-contained power units are interconnected providing a pool of power, which can be distributed to the azimuthing thrusters as needed. In still another embodiment, no self contained units are needed, and power from the semi-submersible can directly run the thrusters. In yet another embodiment, gas turbines can replace the diesel electric self contained units.

Each self-contained power unit 58 has an engine 62 with a fuel tank 64, a cooling system 66, an exhaust system 68, an alternator 70, an electrical control system 72, an electric starter system 74, and a power source 76. An engine mount 83 can be mounted for supporting the engine in the power unit housing. The engine 62 can be a diesel engine 62, which can be activated with the power source 76 and the electrical system starter 74. The power source 76 can be a lead acid battery. The fuel tank 64 then supplies fuel for running the engine 62. Exhaust produced by the system is then evacuated through the exhaust system 68.

The steering motor (seen in FIG. 2) is then powered by the self contained power unit 58 for positioning the azimuthing thruster 22. The diesel engine 62 is coupled to a generator 78. A variable frequency drive 80 provides power the electric motor through the multiconductor slip ring assembly and the thruster electric power cable. The diesel electric self-contained power unit 58 can be in communication with the azimuthing thruster 22 through the cable 82.

The engine 62 can be a gas turbine engine or diesel engine with a horsepower that can range from about 500 horsepower to about 20,000 horsepower.

Figure 5:
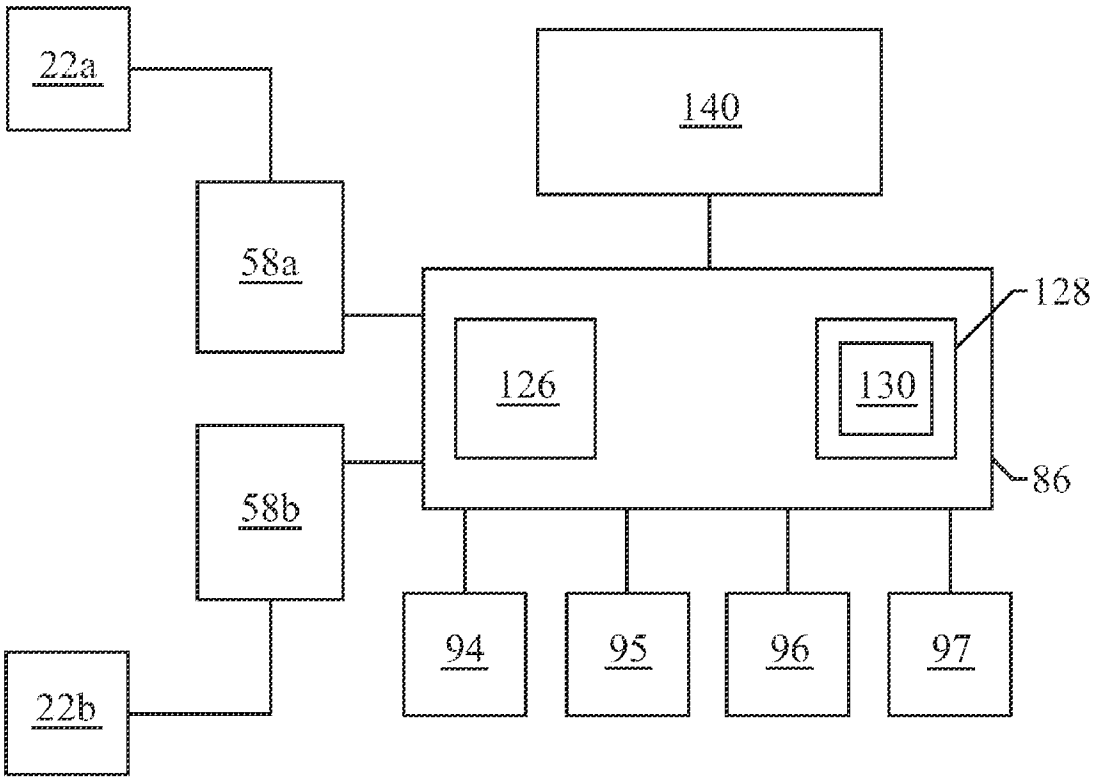
FIG. 5 shows a schematic view of pairs of removable azimuthing thrusters connected to the self contained diesel electric power unit and the communication dynamic positioning system.

FIG. 5 illustrates a schematic of a pair of removable azimuthing thrusters (22*a*, 22*b*) connected to the self contained power units (58*a*, 58*b*) in communication with a dynamic positioning system 86. The dynamic positioning system 86 includes a processor 126 in communication with data storage 128 containing computer instructions 130. The dynamic positioning system 86 is adapted to receive position reference data, motion reference data, vessel heading data, and wind data. The dynamic positioning system 86 sends commands to each azimuthing thruster control system (72, seen in FIG. 4) to position the vessel and control heading of the vessel relative to a preset location and heading. The dynamic positioning system 86 can also receive feedback data from each azimuthing thruster control system (72, seen in FIG. 4).

The computer instructions 130 include instructions for taking the sensed data from each sensor and determining how much power in what direction each thruster needs to be utilized in order to either maintain the entire submersible in a desired position or to move the submersible to a desired position.

At least one positioning reference sensor 94 can be in communication with the processor 126 of the dynamic positioning system 86, but numerous ones can be used. For example, up to 20 can be used for a single vessel. FIG. 5 illustrates a second positioning reference sensor 96.

The position reference sensors can be one or more of the following sensors: global positioning system (GPS) sensors, differential correction sensors, hydro-acoustic sensors for determining a location relative to a moving underwater target or a fixed point on a sea bottom, fan beam laser sensors for determining a location relative to a fixed structure above the sea, Artimis system signal sensors, vertical taut wire system sensors, horizontal taut wire system sensors or Differential and Absolute Reference Positioning System (DARPS) sensors.

The dynamic positioning system 86 can include at least one uninterruptible power source 140 which can be connected to dynamic positioning system 86.

At least one motion reference sensor 95 obtains motion reference data and provides the motion reference data to the dynamic positioning system 86. The motion reference data allows the dynamic positioning system to compensate for movement of the vessel due to roll, pitch, or yaw.

There is also a heading reference sensor for providing vessel heading data to the dynamic positioning system 86. A wind sensor 97 is in communication with the dynamic position system 86 for transmitting the wind data to the dynamic position control system 86.

The dynamic position system 86 receives feedback data from each control system. The feedback data can relate to propeller RPM, such as 500 revolutions per minute. The feedback data can also relate to the angle of the azimuthing drive in relation to the vessel heading. For example, the angle of the azimuthing drive would be between 0 and 360 degrees.

When any repairs are needed, an azimuthing thruster can be removed from and returned to service in the shortest time possible. Time consuming dry docking is avoided when addressing a thruster requiring maintenance or repair. Thruster repair or maintenance activities can be pursued while the vessel continues operations or is in transit. Hydraulic cylinders can simply lift the thruster out of the water above the deballasted waterline. The thruster can be repaired and then lowered again for operation.

In another embodiment of the system, the tube can be movably mounted to the upper thruster housing, such as by using a slewing bearing.

While the presently preferred usage context of the system is dynamic positioning of vessels, barges and other floating structures, it can be used in many forms of seaborne as well as inland waterborne operations or installations, such as dredging, deep sea mining, seismic operations, surveys, pipe and cable laying, subsea construction and repair, salvage and recovery, offshore drilling, military operations, oceanographic research and others, whereby the vessels or structures are or may be required to maintain a desired station or to move in any desired horizontal direction with or without a change of heading.

While these embodiments have been described with emphasis on the embodiments, it should be understood that within the scope of the appended claims, the embodiments might be practiced other than as specifically described herein.

What is claimed is:

1. A modular removable externally mountable diesel electric thruster system for dynamic positioning of a floating semi-submersible vessel with a ballasted waterline comprising at least one pontoon, wherein each pontoon comprises at least one vertical column integral with a top of the at least one pontoon, and wherein each vertical column supports a deck above the ballasted waterline, the system comprising:

a. at least one pair of azimuthing thrusters, wherein each azimuthing thruster is removably mounted to the at least one pontoon of the floating semi-submersible vessel, wherein each azimuthing thruster generates a variable thrust and, wherein each azimuthing thruster comprises:
   1. a skid removably secured to a top portion of the pontoon below the ballasted waterline;
   2. an upper thruster housing removably connected to the skid, wherein the upper thruster housing contains a slewing bearing with at least one electric motor driven slewing drive, at least one electrical steering angle feedback sensor for indicating a steering angle of the azimuthing thruster, and a multi-conductor slip ring assembly;
   3. a tube moveably connected to the upper thruster housing on one end and removably connected on another end to an electric pod having a nozzle;
   4. an electric motor inside the electric pod with a propeller drive shaft, wherein a fixed pitch propeller is removably mounted to the propeller drive shaft; and
   5. a thruster electric power cable connected to the electric motor on one end and to the multi-conductor slip ring assembly on another end;

b. at least one pair of diesel electric power units removably secured to the deck, wherein each diesel electric power unit engages one of the azimuthing thrusters, and wherein each diesel electric power unit comprises:
   1. a power unit housing;
   2. a diesel engine within the power unit housing,
   3. an electric generator driven by the diesel engine;
   4. a variable frequency drive connected to the electric generator;
   5. a fuel tank connected to the diesel engine;
   6. a cooling system for cooling within the power unit housing;
   7. a starter system for the diesel engine;
   8. an exhaust system connected to the diesel engine; and
   9. a control system for controlling the diesel engine, electric generator, starter system, cooling system, fuel tank, variable frequency drive and combinations thereof;

c. at least one pair of electric power cables and a thruster electric control cable, wherein one end of each electric power cable and each thruster electric control cable is secured to the diesel electric power unit and another end is secured to one of each pair of azimuthing thrusters;

d. a dynamic positioning system connected to the diesel electric power unit; and e. at least two position reference sensors and at least two environmental reference sensors connected to the dynamic positioning system.

2. The system of claim 1, further comprising at least one engine mount for supporting the diesel engine in the power unit housing.

3. The system of claim 1, wherein the electric generator is in communication with:

a voltage regulator;

a generator control system; and a main breaker.

4. The system of claim 1, wherein from about two to eight pairs of azimuthing thrusters are removably mounted to each pontoon.

5. The system of claim 1, wherein the thruster upper housing is removably mounted to a side of each pontoon.

6. The system of claim 1, wherein the thruster upper housing is movably hinge mounted in the skid, and wherein hydraulic cylinders allow for hydraulic tilt of the thruster upper housing, the tube, and the electric pod.

7. The system of claim 1, wherein the electric motor is a variable speed AC electric motor.

8. The system of claim 1, wherein the electric motor is a variable speed DC electric motor, and wherein a Silicon-controlled rectifier (SCR) controls revolutions per minute of the variable speed DC electric motor.

9. The system of claim 1, wherein the electric motor is reversible in direction of rotation.

10. The system of claim 1, wherein the skid is mounted above the ballasted waterline.

11. The system of claim 1, wherein the semi-submersible vessel is a semi-submersible drilling vessel, a semi-submersible crane vessel, a floating dry dock, an accommodation vessel, a construction support vessel, a multi-column semi-submersible vessel, a semi-submersible work-over vessel, a floatover vessel, or a space craft launching platform.

12. The system of claim 1, wherein power is supplied from gas turbine driven electric power units.

13. The system of claim 1, wherein power is supplied from the floating semi-submersible vessel.

* * * * *